US010071468B2

(12) United States Patent
Kuhnle et al.

(10) Patent No.: US 10,071,468 B2
(45) Date of Patent: Sep. 11, 2018

(54) HAND-POWER TOOL WITH AN OSCILLATION-DAMPING DEVICE

(75) Inventors: Alex Kuhnle, Freiberg A.N. (DE); Matthias Tauber, Bad Boll (DE); Juergen Bochert, Stuttgart (DE); Carsten Diem, Ludwigsburg (DE); Willy Braun, Neustetten (DE); Christian Wiedemann, Wiernsheim (DE); Joerg Kaiser, Schwieberdingen (DE); Patrick Heinen, Ludwigsburg (DE); Roger Hahn, Neuhausen (DE); Thomas Speda, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 1649 days.

(21) Appl. No.: 13/515,652

(22) PCT Filed: Oct. 22, 2010

(86) PCT No.: PCT/EP2010/065967

§ 371 (c)(1),
(2), (4) Date: Jun. 13, 2012

(87) PCT Pub. No.: WO2011/072916

PCT Pub. Date: Jun. 23, 2011

(65) Prior Publication Data

US 2012/0255753 A1 Oct. 11, 2012

(30) Foreign Application Priority Data

Dec. 16, 2009 (DE) ..... 10 2009 054 731

(51) Int. Cl.
*B25D 17/24* (2006.01)
*B25F 5/00* (2006.01)

(52) U.S. Cl.
CPC ..... *B25F 5/006* (2013.01); *B25D 17/24* (2013.01); *B25D 2211/068* (2013.01); *B25D 2217/0092* (2013.01); *B25D 2250/121* (2013.01)

(58) Field of Classification Search
CPC ..... B25D 17/24; B25D 2217/0092; B25D 2217/0073; B25D 2217/0076; B25D 17/11; B25F 5/006
(Continued)

(56) References Cited

U.S. PATENT DOCUMENTS 1,845,825 A * 2/1932 Benedict ..... 173/162.2
3,845,827 A 11/1974 Schulin
(Continued)

FOREIGN PATENT DOCUMENTS

CN 1974139 A 6/2007
CN 101130241 A 2/2008
(Continued)

OTHER PUBLICATIONS

International Search Report corresponding to PCT Application No. PCT/EP2010/065967, dated Jan. 31, 2011 (German and English language document) (7 pages).

*Primary Examiner* — Andrew M Tecco
*Assistant Examiner* — Chinyere Rushing-Tucker
(74) *Attorney, Agent, or Firm* — Maginot, Moore & Beck LLP

(57) ABSTRACT

A hand-power tool includes at least one oscillation-damping device that has at least one damping spring, a damping mass, and a mechanism housing. The oscillation-damping device has at least two retaining parts that at least partly enclose the damping mass.

10 Claims, 5 Drawing Sheets

(58) Field of Classification Search
USPC ..... 173/162.2, 162.1, 201, 210
See application file for complete search history.

(56) References Cited

U.S. PATENT DOCUMENTS

| | | | | |
|---|---|---|---|---|
| 4,279,091 | A * | 7/1981 | Edwards | 42/1.06 |
| 4,385,665 | A | 5/1983 | Knoll | |
| 8,434,565 | B2 * | 5/2013 | Hecht et al. | 173/162.1 |
| 2006/0289185 | A1 * | 12/2006 | Hahn | 173/210 |
| 2009/0223693 | A1 * | 9/2009 | Aoki | 173/211 |

FOREIGN PATENT DOCUMENTS

| | | | |
|---|---|---|---|
| CN | 101306530 | A | 11/2008 |
| CN | 101323107 | A | 12/2008 |
| CN | 101352849 | A | 1/2009 |
| CN | 101524836 | A | 9/2009 |
| EP | 1 439 038 | A1 | 7/2004 |
| EP | 1 736 283 | A2 | 12/2006 |
| EP | 1 767 315 | A1 | 3/2007 |
| EP | 1 792 692 | A2 | 6/2007 |
| EP | 1 892 062 | A2 | 2/2008 |
| EP | 2 018 939 | A2 | 1/2009 |
| EP | 2 100 698 | A2 | 9/2009 |
| EP | 2 103 393 | A1 | 9/2009 |
| EP | 2 159 008 | A2 | 3/2010 |
| EP | 2 193 885 | A1 | 6/2010 |
| JP | 2006 062039 | A | 3/2006 |

* cited by examiner (Section A-A)

(Section B-B)

(Section C-C)

HAND-POWER TOOL WITH AN OSCILLATION-DAMPING DEVICE

This application is a 35 U.S.C. § 371 National Stage Application of PCT/EP2010/065967, filed on Oct. 22, 2010, which claims the benefit of priority to Serial No. DE 10 2009 054 731.2, filed on Dec. 16, 2009 in Germany, the disclosures of which are incorporated herein by reference in their entirety.

BACKGROUND

The disclosure relates to a portable power tool.

A portable power tool having at least one vibration absorbing device which has at least an absorption spring, an absorption mass and a mechanism housing is already known from EP 1 736 283 A2.

SUMMARY

The disclosure relates to a portable power tool having at least one vibration absorbing device which has at least an absorption spring, an absorption mass and a mechanism housing.

It is proposed that the vibration absorbing device has at least two holding parts which at least partially enclose the absorption mass. In particular, a "portable power tool" should be understood as meaning all portable power tools that appear to be practical to a person skilled in the art, such as, in particular, percussion drilling machines, jackhammers, rotary hammers, percussion hammers, percussion drill/drivers and/or advantageously rotary and/or demolition hammers. A "vibration absorbing device" should be understood as meaning in particular a device which, in at least one operating state, produces a force on a portable power tool housing and/or a mechanism housing and in particular on at least one handle of the portable power tool, said force counteracting a vibration in particular of the portable power tool housing. In this way, the vibration absorbing device allows advantageously low-vibration operation of the portable power tool. Preferably, the vibration absorbing device works passively, that is to say without supplying energy apart from the vibration energy. In particular, the term "absorption spring" should be understood as meaning a spring which is provided to transmit a force, in particular directly, to the absorption mass, said force accelerating and/or decelerating the absorption mass. Advantageously, the absorption spring is formed as a helical compression spring. Alternatively or in addition, the absorption spring could have a rectangular cross section perpendicularly to a spring direction or a plurality of absorption springs could be arranged in a nested and/or coaxial manner. Likewise alternatively or in addition, the absorption spring could be formed as some other torsion spring, flexible spring, tension spring and/or gas spring which appears to be practical to a person skilled in the art. A "spring direction" should be understood as meaning in particular at least a direction in which the absorption spring has to be loaded in order to be able to elastically store the most energy. Advantageously, the absorption spring is formed to be elastically deformable in the spring direction by at least 25% of a length in the unloaded state. An "absorption mass" should be understood as meaning in particular a unit which is provided to reduce the vibration in particular of the portable power tool housing by inertia by means of an acceleration force and/or a deceleration force, advantageously in that said unit vibrates in a manner shifted through a phase angle with respect to the portable power tool housing. The term "provided" should be understood as meaning in particular specially equipped and/or designed. A "holding part" should be understood as meaning in particular an element of the vibration absorbing device which is connected to the housing cover such that it cannot move in relation to the housing cover in a fitted operating state. Preferably, the holding part has a fastening means which fastens the vibration absorbing device and in particular the absorption spring directly to the mechanism housing. Preferably, the holding part and the absorption spring are connected directly together. In particular, the holding part is a component formed separately from the mechanism housing and advantageously from a housing cover. Advantageously, the holding part additionally exerts a force on at least one element of a drive mechanism in a fitted operating state. A "fastening means" should be understood as meaning in particular a means which is provided to bring about a force on the vibration absorbing device, said force fastening at least one element of the vibration absorbing device, preferably the holding part, such that it cannot move in relation to the fitted housing cover. Advantageously, the fastening means is formed at least partially in one piece with the housing cover. The fastening means is formed as a groove, as part of a screw connection, as part of a latching connection and/or as part of some other connection that appears to be practical to a person skilled in the art. A "mechanism housing" should be understood as meaning in particular a housing in which at least the drive mechanism is arranged in a protected manner. Advantageously, the mechanism housing is formed at least partially in one piece with the portable power tool housing. Advantageously, the mechanism housing is provided to dissipate bearing forces, at least of the drive mechanism. The term "enclose" should be understood as meaning in particular that the holding parts surround at least one point of the absorption mass on a plane with is oriented preferably perpendicularly to the spring direction, by at least 180 degrees, advantageously at least 270 degrees, particularly advantageously 360 degrees. By way of the embodiment according to the disclosure, a particularly robust, compact and cost-effective portable power tool, which allows particularly low-vibration operation, can be provided in a structurally simple manner. In particular, small guide forces and a low degree of friction, and thus a low degree of wear, can be achieved as a result.

It is further proposed that at least the absorption spring brings about a fastening force on the mechanism housing and in particular on a housing cover of the mechanism housing in at least one operating state, as a result of which assembly with a particularly low amount of effort can be achieved. In particular, the expression "bring about a fastening force" should be understood as meaning that the absorption spring exerts on the mechanism housing the fastening force which counteracts and advantageously prevents a movement at least of a part of the vibration absorbing device in relation to the mechanism housing, in particular a movement of the holding parts. In particular, the fastening force pushes the holding parts away from one another.

In addition, it is proposed that the holding parts are formed as identical parts, as a result of which design outlay can advantageously be saved. "Identical parts" should be understood as meaning in particular components which have identical external dimensions. Preferably, the identical parts are formed in a mirror-inverted manner with respect to one another. Alternatively, the identical parts could have an identical external appearance.

Furthermore, it is proposed that the holding parts are provided to guide the absorption spring, as a result of which particularly reliable operation and high ease of maintenance can be achieved. In this connection, "guide" should be understood as meaning in particular that the holding parts are provided to exert a bearing force perpendicularly to the spring direction on the absorption spring. Preferably, the force prevents a substantial movement, deviating from the spring direction, of the absorption spring.

In an advantageous embodiment of the disclosure, it is proposed that the vibration absorbing device has at least one spring receptacle which is connected in a form-fitting manner to the absorption mass, as a result of which a particularly inexpensive, easy to maintain and space-saving connection is possible in a structurally simple manner. A "spring receptacle" should be understood as meaning in particular an element of the vibration absorbing device which is arranged in a flux of force between the absorption spring and absorption mass. Advantageously, the spring receptacle is connected in a mechanically fixed manner to the absorption mass. Preferably, the spring receptacle is movable in relation to the mechanism housing. A "form fit" should be understood as meaning in particular a connection which transmits a force in a force direction over at least one surface, said force having an average extent substantially perpendicular to the force direction. In this case, a spatial configuration of the spring receptacle and of the absorption mass advantageously prevents a movement of the spring receptacle in relation to the absorption mass. Alternatively or in addition, the spring receptacle and the absorption mass could be connected together in a force-fitting, friction-fitting or materially integral manner.

In a further embodiment, it is proposed that the portable power tool has a mechanism housing having a housing cover which has a fastening means which at least partially fastens the vibration absorbing device in at least one operating state. A "housing cover" should be understood as meaning in particular an element of the mechanism housing which is formed to be separable from another element of the mechanism housing, in particular a housing shell, without being damaged. Advantageously, the vibration absorbing device and the drive mechanism are arranged in a chamber which is closed by the housing cover. In other words, the vibration absorbing device is arranged on an inner side of the housing cover. As a result, it is protected particularly advantageously from external influences such as dirt and mechanical damage in a structurally simple manner. Advantageously the chamber is formed as a grease chamber of the portable power tool. Advantageously, the housing cover is provided to close an opening, which is provided in particular for fitting the drive mechanism, in the other element of the mechanism housing. Advantageously, the housing cover is free of bearing forces of the drive mechanism. Particularly advantageously, the housing cover transmits primarily forces of the vibration absorbing device and in particular forces which act externally on the bearing cover. In particular, a "drive mechanism" should be understood as meaning a mechanism which converts a movement of a drive motor into a working movement, in particular a percussion movement. In particular the term "close" should be understood as meaning that the housing cover covers an opening in the other element of the mechanism housing, in particular the housing shell, in an operationally ready state. As a result, the housing cover protects the chamber from contamination, that is to say that it prevents dirt and in particular dust from penetrating through the opening to the drive mechanism.

Furthermore, it is proposed that the vibration absorbing device has at least one spring receptacle which exerts an acceleration force on the absorption mass in at least one operating state and supports an opposing force to the acceleration force on the holding part in at least one operating state, as a result of which a particularly small installation space requirement and low costs can be achieved. Advantageously, the spring receptacle exerts the acceleration force at one point in time and supports the opposing force at another point in time. In particular an "acceleration force" should be understood as meaning a force which accelerates and/or decelerates the absorption mass. An "opposing force" should be understood as meaning in particular a force which supports the absorption spring on one side when on the other side of the absorption spring the acceleration force acts on the absorption mass.

In a further embodiment, it is proposed that the vibration absorbing device has at least one support element which presses the spring receptacle against the absorption spring in at least one operating state, as a result of which particularly low design outlay, an advantageous spring characteristic of the vibration absorbing device and advantageous compensation of tolerances can be achieved. In particular, it is possible to dispense with a form-fitting, materially integral and/or frictional connection between the spring receptacle and the absorption mass. A "support element" should be understood as meaning in particular an element which brings about a force on the spring receptacle in at least one operating state, said force counteracting a force which the absorption spring brings about on the spring receptacle. Advantageously, the support element is formed as a cylindrical compression spring, as an elastomeric part, as a wave spring or disk spring and/or as some other element that appears to be practical to a person skilled in the art. Preferably, the force of the support element on the spring receptacle in at least one operating state is, advantageously always, much smaller than a force of the absorption spring on the same spring receptacle. "Much smaller" should be understood in this context as meaning in particular less than 50%, advantageously less than 25%, particularly advantageously less than 10%, of the force of the absorption spring. Alternatively, it would also be possible to dispense with support elements in the vibration absorbing device.

Furthermore, it is proposed that the absorption spring is arranged entirely in an axial region of the absorption mass, as a result of which an advantageously small overall length in the spring direction can be achieved. An "axial region of the absorption mass" should be understood as meaning in particular a region which is bounded by two planes, which are oriented perpendicularly to the spring direction and intersect the absorption mass.

Furthermore, it is proposed that the housing cover and the vibration absorbing device form a preassemblable subassembly, as a result of which an advantageously low amount of assembly effort can be achieved. The expression "form a preassemblable subassembly" should be understood as meaning in particular that, during fitting, in particular before the housing cover is fastened to the mechanism housing, the housing cover and the vibration absorbing device can be connected fixedly together. As a result, the housing cover and the vibration absorbing device can be connected to form a fittable unit. Advantageously, the housing cover and the vibration absorbing device can be connected together such that they can be fitted jointly. Particularly advantageously, the housing cover and the vibration absorbing device can be connected together such that they can transmit the acceleration force and/or an opposing force to the acceleration force.

BRIEF DESCRIPTION OF DRAWINGS

Further advantages can be gathered from the following description of the drawing. The drawing illustrates two exemplary embodiments of the disclosure. The drawing, the description and the claims contain numerous features in combination. A person skilled in the art will expediently view the features individually and combine them to form practical further combinations.

In the drawing.

DETAILED DESCRIPTION

Figure 1:
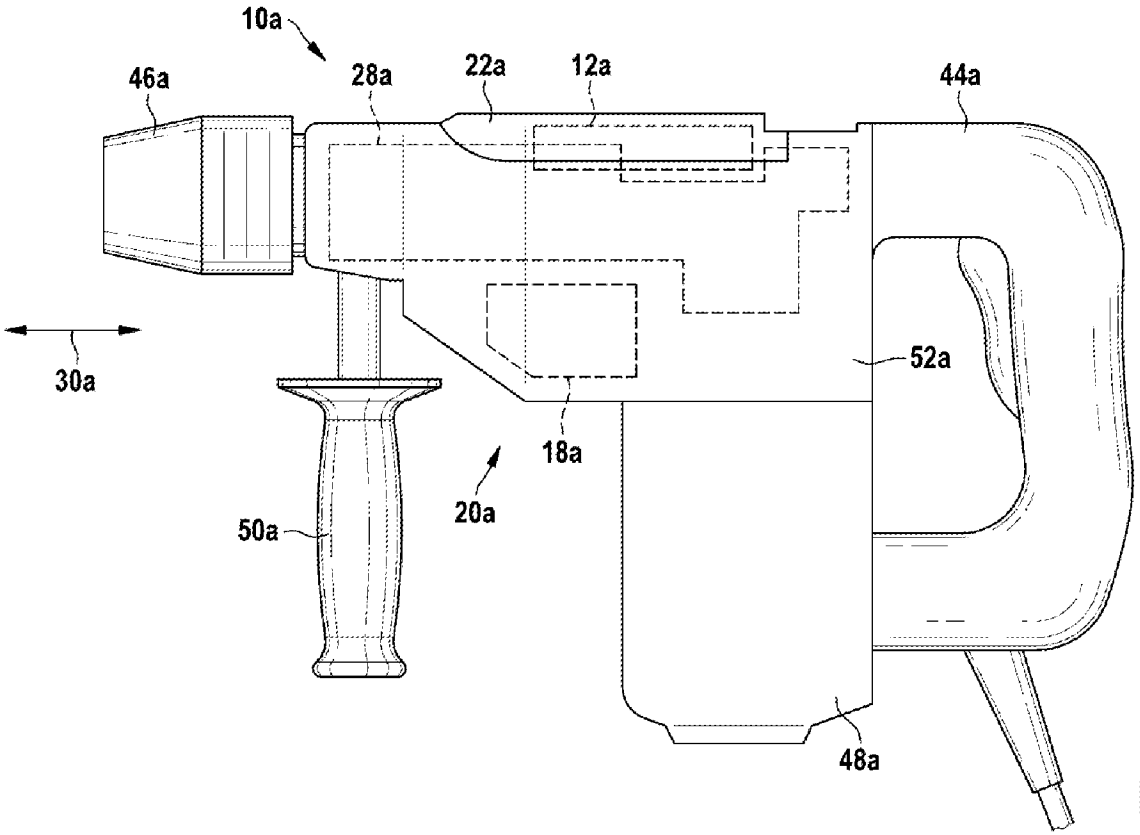
FIG. 1 shows a portable power tool according to the disclosure, having a vibration absorbing device which is fastened to a housing cover.

FIG. 1 shows a portable power tool 10*a* according to the disclosure having a vibration absorbing device 12*a*, a drive mechanism 18*a* and having a mechanism housing 20*a*which has a metal housing cover 22*a*. The portable power tool 10*a* is formed as a rotary and demolition hammer. The mechanism housing 20*a* encloses a chamber 24*a* in which the drive mechanism 18*a* and the vibration absorbing device 12*a* are arranged. Furthermore, the portable power tool 10*a* has a main handle 44*a*, an application tool fastening 46*a*, a motor housing 48*a*and an auxiliary handle 50*a*. The main handle 44*a* is connected to the mechanism housing 20*a*and the motor housing 48*a* on a side of the mechanism housing 20*a* that is remote from the application tool fastening 46*a*. The auxiliary handle 50*a* is connected to the mechanism housing 20*a* on a side facing the application tool fastening 46*a*.

Figure 2:
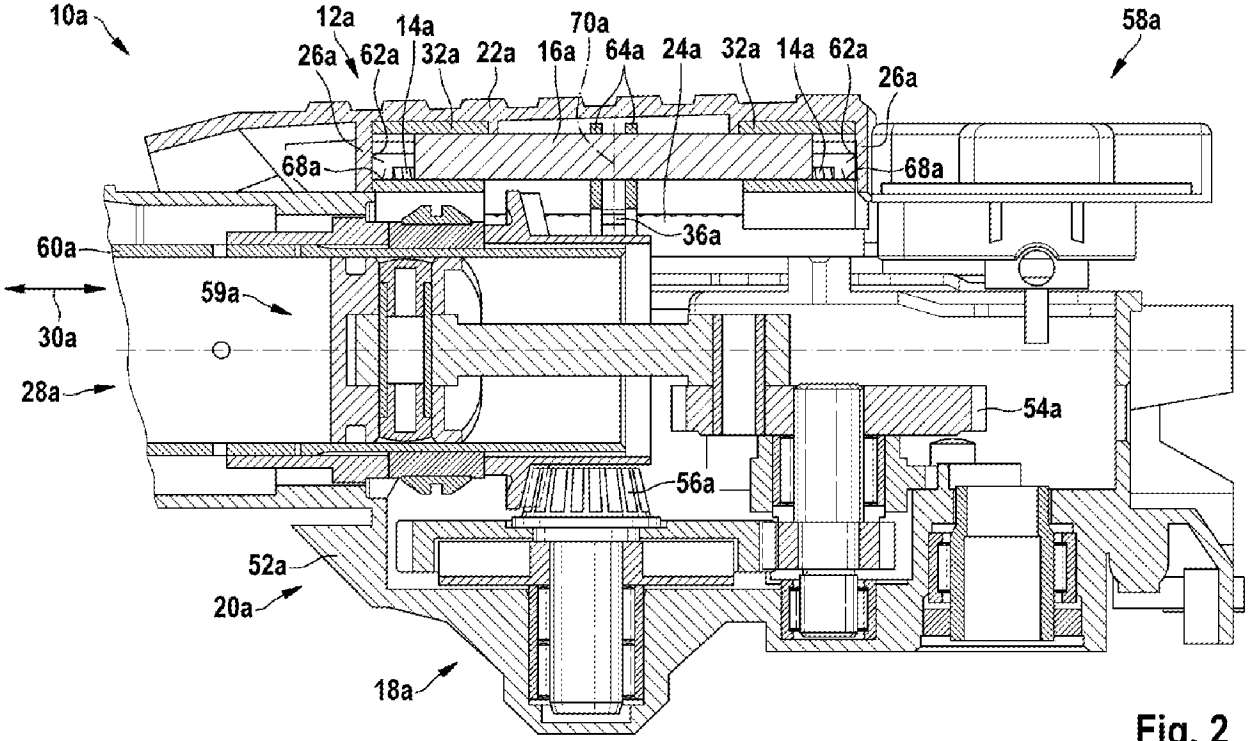
FIG. 2 shows a section through the portable power tool from FIG. 1.
Figure 3:
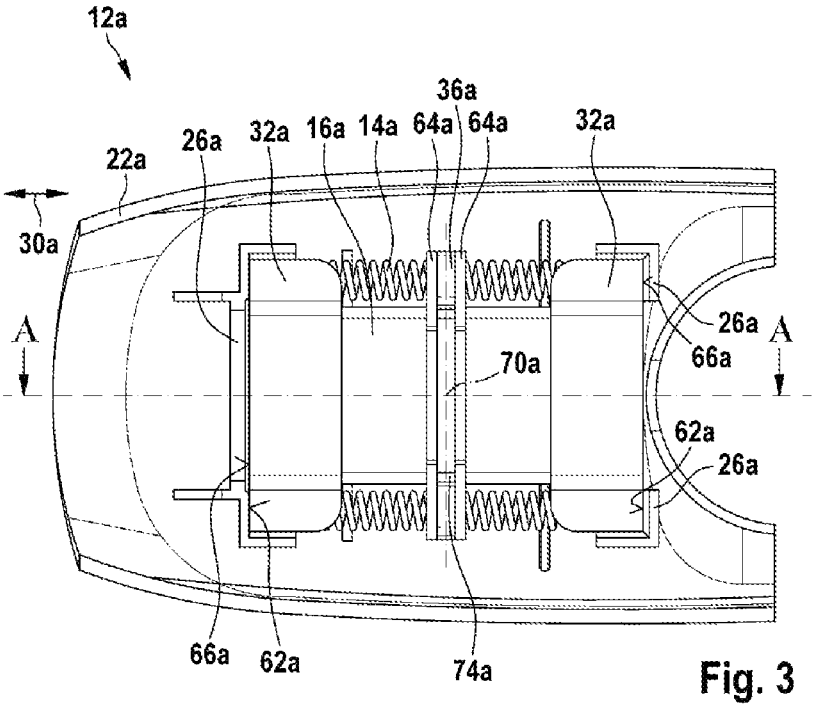
FIG. 3 shows a housing cover and the vibration absorbing device of the portable power tool from FIG. 1.
Figure 4:
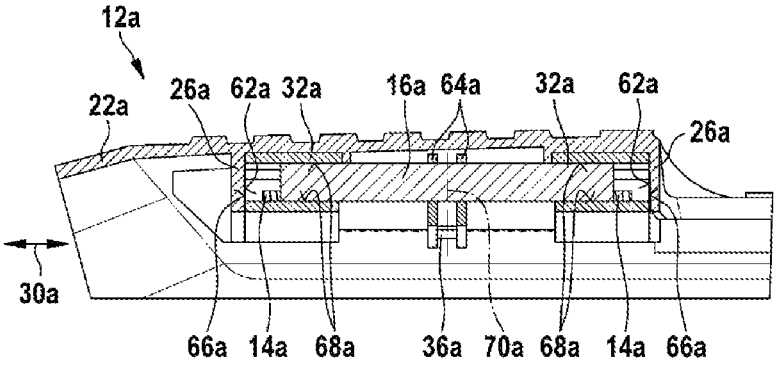
FIG. 4 shows a section (A-A) through the housing cover and the vibration absorbing device.

FIG. 2 shows a section through the mechanism housing 20*a*, which has a housing shell 52*a* in addition to the housing cover 22*a*. Arranged in the chamber 24*a* are the vibration absorbing device 12*a* and the drive mechanism 18*a*. The drive mechanism 18*a* has a percussion mechanism 28*a*, a first and a second transmission element 54*a*, 56*a* for drilling operation and a switching mechanism 58*a*. The percussion mechanism 28*a* is formed as a hammer percussion mechanism. The first transmission element 54*a* is formed additionally as an eccentric element of the percussion mechanism 28*a*. Furthermore, the percussion mechanism 28*a* has a piston 59*a*, a hammer tube 60*a* and, not illustrated in more detail, a striker and an anvil. The second transmission element 56*a* drives the hammer tube 60*a* in rotation. The rotational movement of the hammer tube 60*a* can be switched off by the switching mechanism 58*a* in a manner that appears to be practical to a person skilled in the art.

The housing cover 22*a* of the mechanism housing 20*a* is arranged on a side of the housing shell 52*a* that is opposite the motor housing 48*a*. It closes a fitting opening located there, and thus the chamber 24*a*. The portable power tool 10*a* has a seal (not illustrated in more detail), which is arranged between the housing cover 22*a* and the housing shell 52*a*. As a result, the vibration absorbing device 12*a* and the drive mechanism 18*a* are protected from contamination. The chamber 24*a* is formed as a grease chamber, that is to say that joint, permanent lubrication is ensured in the chamber 24*a*. The vibration absorbing device 12*a* and the drive mechanism 18*a* are arranged in the chamber 24*a*, which is closed by the housing cover 22*a*.

As is shown in FIGS. 3 to 7, the housing cover 22*a* has three fastening means 26*a*. The fastening means 26*a* are formed as integrally formed webs. The fastening means 26*a* have fastening surfaces 62*a* oriented perpendicularly to a spring direction 30*a*. The fastening means 26*a* fasten the vibration absorbing device 12*a* in the spring direction after the fitting of the subassembly, that is to say after the vibration absorbing device 12*a* has been inserted into the cover, and during operation. To this end, during fitting, the vibration absorbing device 12*a* is compressed in the spring direction 30*a* and inserted into the housing cover 22*a*. As a result, absorption springs 14*a* of the vibration absorbing device 12*a* bring about a fastening force on the housing cover 22*a* by prestressing in the spring direction 30*a* after the fitting of the subassembly and during operation. The fastening force fastens the vibration absorbing device 12*a* to the housing cover 22*a* in a force-fitting manner perpendicularly to the spring direction 30*a*. Thus, the vibration absorbing device 12*a* and the housing cover 22*a* form a preassemblable subassembly, that is to say that the vibration absorbing device 12*a* and the housing cover 22*a* form together, and separately from the housing shell 52*a*, an inherently stable unit.

Following fitting of the housing cover 22*a* on the housing shell 52*a*, the housing shell 52*a* brings about a fastening force on the vibration absorbing device 12*a* in a region which is not illustrated in more detail. The fastening force acts perpendicularly to the spring direction 30*a*. Alternatively or in addition, the vibration absorbing device 12*a* could be latched, screwed, adhesively bonded and/or connected to the housing cover 22*a* in some other way that appears to be practical to a person skilled in the art.

The percussion mechanism 28*a* and the vibration absorbing device 12*a* are arranged partially on identical planes, which are oriented perpendicularly to a spring direction 30*a*, that is to say that the percussion mechanism 28*a* and the vibration absorbing device 12*a* are arranged partially adjacent to one another. A region of the vibration absorbing device 12*a* that faces the application tool fastening 46*a* is arranged between the housing cover 22*a* and the percussion mechanism 28*a*. This region is free of functional components apart from the vibration absorbing device 12*a*.

The vibration absorbing device 12*a* is formed in a mirror-symmetrical manner in a rest state. It has four absorption springs 14*a*, an absorption mass 16*a*, two holding parts 32*a*, two spring receptacles 36*a* and two spring receptacle fastenings 64*a*. The two holding parts 32*a* are formed as identical parts, that is to say that they have an identical but mirror-inverted form with respect to one another. In addition, the holding parts 32*a* have a slight oversize with respect to the housing cover 22*a*. Outer sides 66*a* of the holding parts 32*a*, which face or are remote from the application tool fastening, fasten the vibration absorbing device 12*a* in the housing cover 22*a*. The absorption springs 14*a*, the absorption mass 16*a*, the two spring receptacles 36*a* and the two spring receptacle fastenings 64*a* are arranged between the holding parts 32*a*. The spring receptacles 36*a* and the spring receptacle fastenings 64*a* are produced at least partially from plastics material.

The holding parts 32*a* have guide surfaces 68*a*, which guide the absorption mass 16*a* in the spring direction 30*a* during operation. For this purpose, the holding parts 32*a* enclose the absorption mass 16*a* on a plane which is formed perpendicularly to the spring direction 30*a*. In this exemplary embodiment, the holding parts 32*a* enclose the absorption mass 16*a* entirely.

Alternatively, the holding parts 32*a* could enclose the absorption mass 16*a* by more than 180 degrees. The holding parts 32*a* guide the absorption mass 16*a* on surfaces which are arranged furthest away from the center of gravity 70*a* of the absorption mass 16*a*, as a result of which small guide forces and a low degree of friction can be achieved. Alternatively or in addition, a housing cover could also guide the absorption mass 16*a* and/or the absorption spring 14*a*. Furthermore, the holding parts 32*a* each have spring fastenings 72*a*, which fasten the absorption springs 14*a*. For this purpose, the absorption springs 14*a* are screwed onto the spring fastenings 72*a*.

Figure 5:
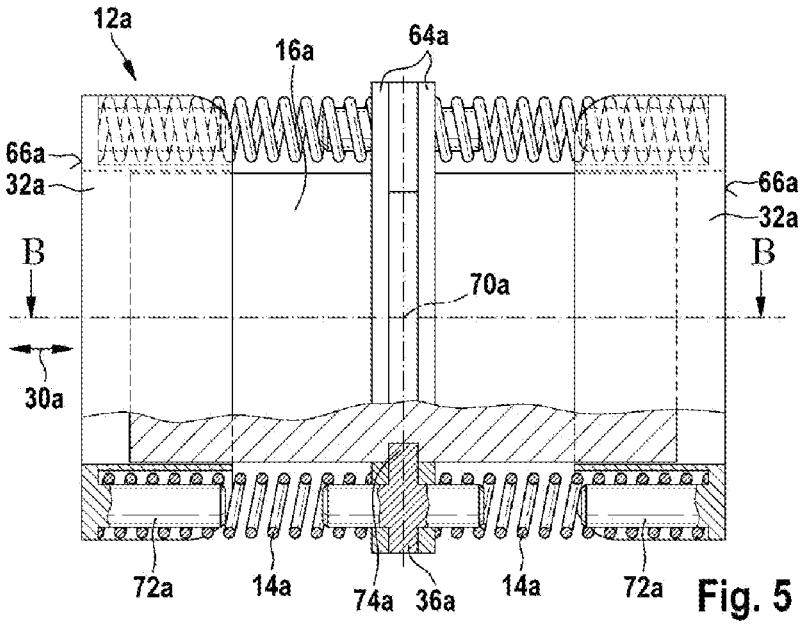
FIG. 5 shows a plan view of a partial section through the vibration absorbing device of the portable power tool from FIG. 1.
Figure 6:
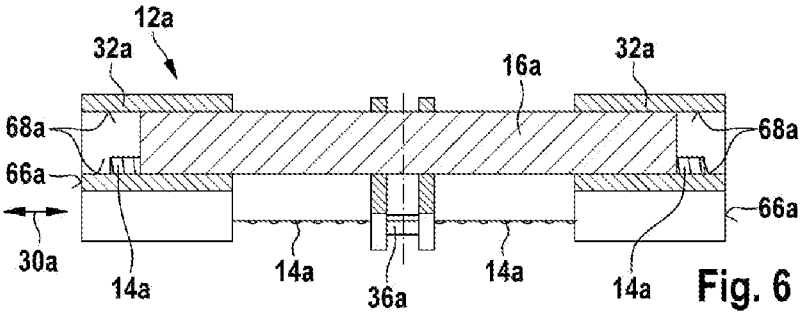
FIG. 6 shows a front view of a section (B-B) through the vibration absorbing device of the portable power tool from FIG. 1.
Figure 7:
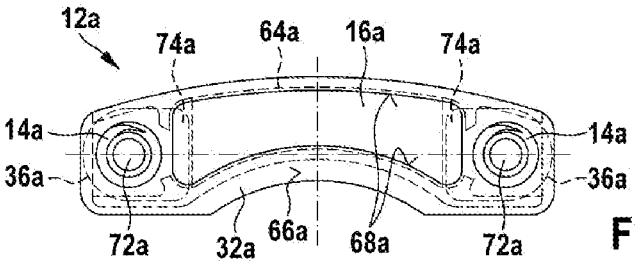
FIG. 7 shows a side view of the vibration absorbing device of the portable power tool from FIG. 1.

The four absorption springs 14*a* are each connected in a mechanically fixed manner on one side to the holding parts 32*a* and on one side to the spring receptacles 36*a*. The spring receptacles 36*a* have a cruciform cross section as seen perpendicularly to the spring direction 30*a* (FIG. 5). On a side facing the center of gravity 70*a* of the absorption mass 16*a*, the spring receptacles 36*a* extend into recesses 74*a* in the absorption mass 16*a*. In this case, the spring receptacles 36*a* are supported on the absorption mass 16*a*. During fitting, the spring receptacle fastenings 64*a* are pushed onto the absorption mass 16*a* and fix the spring receptacles 36*a* such that a form-fitting connection is established between the spring receptacles 36*a* and the absorption mass 16*a*. The spring forces of the absorption springs 14*a* fasten the spring receptacle fastening 64*a*.

In addition, the vibration absorbing device could have damping elements (not illustrated in more detail), which damp a striking of the absorption mass 16*a* against an end stop. For example, the damping elements could be arranged between the spring receptacles 36*a* and the holding parts 32*a* inside the absorption springs 14*a* in a guide for the holding parts 32*a* or on the housing cover 22*a*.

The absorption mass 16*a* has a uniform cross section in the spring direction 30*a*. The cross section is formed by means of an extrusion process. Absorption masses are cut down from a bar by a machine and in the same work step are provided with recesses for accommodating spring receptacles. Alternatively or in addition, an absorption mass could have a plurality of mass parts. Advantageously, at least one of the mass parts likewise has a uniform cross section. Particularly advantageously, at least one of the mass parts has a preferably largely standardized cross section in at least one direction.

Figure 8:
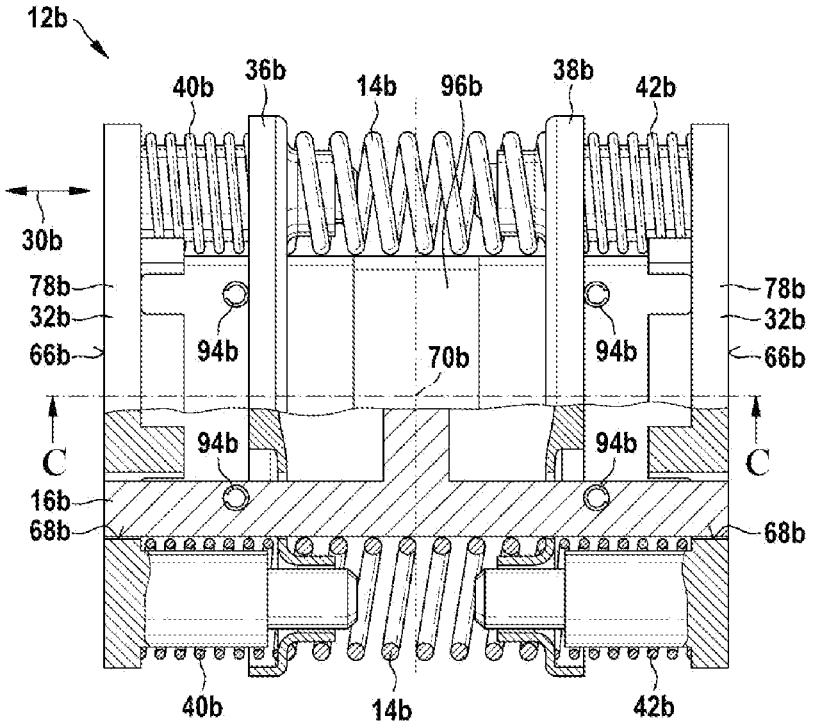
FIG. 8 shows a partial section through an alternative exemplary embodiment of the vibration absorbing device from FIG. 1 with a spring receptacle which is movable in relation to the absorption mass.
Figure 9:
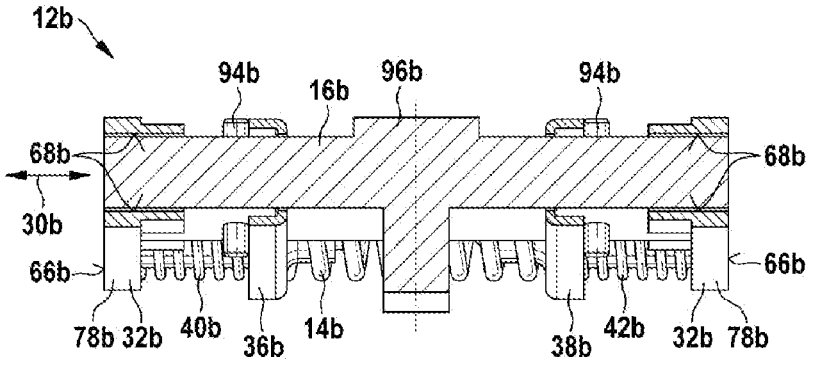
FIG. 9 shows a front view of a section (C-C) through the vibration absorbing device from FIG. 8.

FIGS. 8 and 9 show a further exemplary embodiment of the disclosure. In order to differentiate the exemplary embodiments, the letter a in the reference signs of the exemplary embodiment in FIGS. 1 to 7 has been replaced by the letter b in the reference signs of the exemplary embodiment in FIGS. 8 and 9. The following descriptions are limited substantially to the differences between the exemplary embodiments, it being possible to refer to the description of the other exemplary embodiments, in particular in FIGS. 1 to 7, with regard to components, features and functions which remain the same.

The exemplary embodiment in FIGS. 8 and 9 relates, as described in the exemplary embodiment of FIGS. 1 to 7, to a portable power tool 10*b* according to the disclosure having a vibration absorbing device 12*b* illustrated in FIGS. 8 and 9, a drive mechanism 18*b*and a mechanism housing 20*b* having a housing cover 22*b* and a housing shell 52*b*. In an operationally ready state, the housing cover 22*b* closes a chamber 24*b* in which the drive mechanism 18*b* is arranged. The housing cover 22*b* has fastening means 26*b*, which fasten the vibration absorbing device 12*b* in the operationally ready state.

The vibration absorbing device 12*b* has two absorption springs 14*b*, an absorption mass 16*b*, a first and a second holding part 32*b*, a first and a second spring receptacle 36*b*, 38*b*, and four support elements 40*b*, 42*b*. The holding parts 32*b* are pushed onto the absorption mass 16*b*. There, the holding parts 32*b* are secured by way of immobilizing elements 94*b*. The immobilizing elements 94*b* are formed as clamping sleeves, but could also be formed as other units that appear to be practical to a person skilled in the art. The holding parts 32*b* are mounted in a movable manner in the spring direction 30*b* on the absorption mass 16*b*, specifically between in each case two immobilizing elements 94*b* and a central shoulder 96*b*. The central shoulder 96*b* extends perpendicularly to the spring direction 30*b*.

The first holding part 32*b* and the first spring receptacle 36*b* are arranged facing the application tool fastening 46*b*. In an operating state, the absorption mass 16*b* moves the second spring receptacle 38*b* in the direction of the application tool fastening 46*b*. In the process, the second spring receptacle 38*b* exerts an acceleration force on the absorption mass 16*b*. The acceleration force brakes the absorption mass 16*b*. The second spring receptacle 38*b* in the process transmits movement energy of the absorption mass 16*b* via the immobilizing elements 94*b* to the absorption springs 14*b*. The absorption springs 14*b* buffer store this energy. After the absorption springs 14*b* have stopped the absorption mass 16*b* in relation to the holding parts 32*b*, the absorption springs 14*b* return the energy to the absorption mass 16*b* and thus accelerate the absorption mass 16*b*. During this movement of the absorption mass 16*b* from a central position in the direction of the application tool fastening 46*b*, the first spring receptacle 36*b* supports an opposing force to the acceleration force on the first holding part 32*b*. Once the absorption mass 16*b* has crossed a central position, the same process occurs in a mirror-inverted manner in the opposite direction.

The support elements 40*b*, 42*b* press the spring receptacles 36*b*, 38*b* against the absorption springs 14*b* in two different operating states. A force of the support elements 40*b*, 42*b* is in this case much smaller than the acceleration force of the absorption springs 14*b*. The support elements 40*b*, 42*b* are in this case oriented coaxially with the absorption springs 14*b*. The absorption springs 14*b* are arranged entirely in an axial region, that is to say laterally next to the absorption mass 16*b*.

The invention claimed is:

1. A portable power tool, comprising:

at least one vibration absorbing device which includes:

an absorption mass;

at least one absorption spring defining a spring direction along which the at least one absorption spring transmits a spring force to the absorption mass;

at least two holding parts at least partially enclosing the absorption mass such that the at least two holding parts surround at least one point of the absorption mass on a plane oriented perpendicularly to the spring direction; and at least one spring receptacle connected in a form-fitting and mechanically fixed manner to the absorption mass; and a mechanism housing.

2. The portable power tool as claimed in claim 1, wherein the at least one absorption spring is configured to exert a fastening force on the mechanism housing, the at least one absorption spring and the mechanism housing being configured such that the fastening force counteracts and prevents a movement of at least a portion of the vibration absorbing device in at least one operating state.

3. The portable power tool as claimed in claim 1, wherein the holding parts are formed as identical parts having identical external dimensions.

4. The portable power tool as claimed in claim 1, wherein the holding parts are configured to guide the absorption spring such that the holding parts exert a bearing force on the absorption spring in a direction perpendicular to the spring direction.

5. The portable power tool as claimed in claim 1, wherein the mechanism housing includes a housing cover which has a fastening mechanism configured to fasten at least a portion of the vibration absorbing device such that the portion of the vibration absorbing device cannot move in relation to the housing cover.

6. The portable power tool as claimed in claim 1, wherein the at least one spring receptacle exerts an acceleration force on the absorption mass in a first operating state and exerts an opposition force on the holding part in a second operating state.

7. The portable power tool as claimed in claim 6, further comprising:

at least one support element configured to exert a support force on the at least one spring receptacle in a direction opposite the acceleration force exerted by the absorption spring.

8. The portable power tool as claimed in claim 1, wherein the absorption spring is arranged entirely in an axial region of the absorption mass that is bounded by two planes oriented perpendicularly to the spring direction and which intersect the absorption mass.

9. The portable power tool as claimed in claim 1, wherein the at least one spring receptacle includes a contact surface abutting the absorption mass, and the at least one spring receptacle is configured such that the form-fitting connection transmits a first force between the at least one spring receptacle and the absorption mass over the contact surface in a force direction, and the contact surface extends perpendicular to the force direction.

10. A vibration absorbing system for a portable power tool, comprising:

at least one vibration absorbing device which includes:

an absorption mass;

at least one absorption spring defining a spring direction along which the at least one absorption spring transmits a spring force to the absorption mass;

at least two holding parts at least partially enclosing the absorption mass such that the at least two holding parts surround at least one point of the absorption mass on a plane oriented perpendicularly to the spring direction; and at least one spring receptacle connected in a form-fitting and mechanically fixed manner to the absorption mass; and a mechanism housing.

* * * * *